US010914134B1

(12) United States Patent
Harbi

(10) Patent No.: US 10,914,134 B1
(45) Date of Patent: Feb. 9, 2021

(54) TREATMENT OF CASING-CASING ANNULUS LEAKS USING THERMALLY SENSITIVE SEALANTS

(71) Applicant: SAUDI ARABIAN OIL COMPANY, Dhahran (SA)

(72) Inventor: Atallah N. Harbi, Dammam (SA)

(73) Assignee: SAUDI ARABIAN OIL COMPANY

( * ) Notice: Subject to any disclaimer, the term of this patent is extended or adjusted under 35 U.S.C. 154(b) by 0 days.

(21) Appl. No.: 16/683,916

(22) Filed: Nov. 14, 2019

(51) Int. Cl.
*E21B 33/14* (2006.01)
*E21B 36/00* (2006.01)

(52) U.S. Cl.
CPC ..... *E21B 33/14* (2013.01); *E21B 36/006* (2013.01)

(58) Field of Classification Search
None
See application file for complete search history.

(56) References Cited

U.S. PATENT DOCUMENTS 3,768,566 A * 10/1973 Ely ..... C09K 8/685 166/308.5
4,064,943 A 12/1977 Cavin
4,436,148 A 3/1984 Maxwell
4,612,255 A 9/1986 Hein
5,120,935 A 6/1992 Nenniger
5,273,112 A 12/1993 Schultz
5,287,923 A 2/1994 Cornette et al.
5,957,205 A 9/1999 Bohme et al.
6,186,239 B1 2/2001 Monjure et al.
6,457,528 B1 10/2002 Staudt
6,664,522 B2 12/2003 Spencer
6,959,767 B2 11/2005 Horton et al.
7,252,147 B2 8/2007 Badalamenti et al.
7,328,547 B2 2/2008 Mehta et al.
7,677,314 B2 3/2010 Hsu
7,703,513 B2 4/2010 Vinegar et al.
8,146,654 B2 4/2012 Bragg et al.
8,387,688 B2 3/2013 Carter et al.
8,607,895 B2 12/2013 Hoskins
2008/0004190 A1 1/2008 Marcantonio et al.
2010/0044042 A1* 2/2010 Carter, Jr. ..... E21B 33/138 166/288
2010/0230164 A1 9/2010 Pomerleau

* cited by examiner

*Primary Examiner* — Andrew Sue-Ako
(74) *Attorney, Agent, or Firm* — Bracewell LLP; Constance Gall Rhebergen

(57) ABSTRACT

Embodiments of the disclosure provide a system and method for treating a casing-casing annulus of a wellbore using a sealant material. The sealant material is heated to a first temperature, equal to or greater than the melting point of the sealant material such that the sealant material is in its molten state. The casing-casing annulus is heated to a second temperature, equal to or greater than the melting point of the sealant material. The sealant material in its molten state is pressurized and injected into the casing-casing annulus such that the sealant material in its molten state occupies pore or imperfections of a cemented zone located in the casing-casing annulus. The sealant material is allowed to solidify such that formation fluids are prevented from migrating to the surface of the wellbore.

18 Claims, 2 Drawing Sheets

TREATMENT OF CASING-CASING ANNULUS LEAKS USING THERMALLY SENSITIVE SEALANTS

BACKGROUND

Field of the Disclosure

Embodiments of the disclosure generally relate to treating casing-casing annulus pressure. More specifically, embodiments of the disclosure relate to system and method for treating casing-casing annulus pressure using a thermally sensitive sealant.

Description of the Related Art

After or during the drilling of a wellbore, the wellbore is lined with a metallic pipe referred to as a casing. Cement slurry is pumped between the annulus created by the casing and the wellbore wall and subsequently allowed to harden, forming a structural component of the wellbore. The casing prevents the wellbore wall from caving into the wellbore and maintains control of formation fluids and the pressure of the formation fluids. Multiple casings of different diameters can be lined in the wellbore where cement can be positioned between each annulus created by two adjacent casings (as known as the casing-casing annulus (CCA)) to provide additional structural stability to the wellbore.

In cases, the hardened cement may include certain pores or imperfections such as cracks, microannuli, microchannels, and fractures. Formation fluids such as oil, water, and gases may build up and pressurize the imperfections, which act as pathways for the formation fluids to migrate to the surface creating environmental and safety hazards. A cement slurry may be pumped downhole in attempt to plug these pores or imperfections. However, the cement slurry includes solid materials of various sizes greater than those of the pores or imperfections located on the uphole surface of the hardened cement, where the surface pores or imperfections prevent such solid materials from accessing other pores or imperfections further downhole. In addition, resin-based sealants may be pumped downhole in attempt to plug these pores or imperfections. However, due to the viscosity of the resin-based sealants, the resin-based sealants are not able to access the pores or imperfections further downhole.

SUMMARY

Embodiments of the disclosure generally relate to treating casing-casing annulus pressure. More specifically, embodiments of the disclosure relate to system and method for treating casing-casing annulus pressure using a thermally sensitive sealant.

Embodiments of the disclosure provide a method for treating a CCA of a wellbore using a sealant material. The method includes the step of heating the sealant material to a first temperature. The first temperature is equal to or greater than a melting point of the sealant material such that the sealant material is in its molten state. The method includes the step of heating the CCA to a second temperature. The second temperature is equal to or greater than the melting point of the sealant material. The method includes the step of pressurizing the sealant material in its molten state. The method includes the step of injecting the sealant material in its molten state into the CCA such that the sealant material in its molten state occupies pores or imperfections of a cemented zone located in the CCA. The method includes the step of allowing the sealant material to solidify such that formation fluids are prevented from migrating to a surface of the wellbore. The CCA is formed by a first casing and a second casing. The first casing has an inner diameter greater than an outer diameter of the second casing.

In some embodiments, the method further includes the step of deploying the first casing and the second casing in the wellbore. In some embodiments, the method further includes the step of introducing a cement slurry in the CCA. The method further includes the step of allowing the cement slurry to harden to form the cemented zone. In some embodiments, the method further includes the step of positioning a wellhead uphole of the first casing and the second casing sealing the CCA. In some embodiments, the method further includes the step of bleeding the formation fluids to the surface of the wellbore via a port of the wellhead. In some embodiments, in the heating the CCA step, a preheated gaseous material is injected into the CCA via a port of the wellhead. In some embodiments, the preheated gaseous material includes nitrogen.

In some embodiments, the sealant material includes paraffin wax. In some embodiments, the melting point of the sealant material ranges between 90 deg. C and 150 deg. C. In some embodiments, the melting point of the sealant material is 120 deg. C. In some embodiments, the sealant material in its molten state has a kinematic viscosity ranging between 1 square millimeter per second ($mm^2/s$) and 3.5 $mm^2/s$ at 120 deg. C. In some embodiments, the sealant material in its molten state has a kinematic viscosity of 3 $mm^2/s$ at 120 deg. C. In some embodiments, the first temperature is greater than a temperature of the wellbore. In some embodiments, the heating the sealant material step further includes the sealant material positioned in a supply tank. The supply tank is fluidly connected to the CCA. In some embodiments, the supply tank includes a heating component.

Embodiments of the disclosure also provide a system for treating a CCA of a wellbore. The system includes a sealant material, a first casing, a second casing, a cemented zone, a wellhead, a supply tank, and a pump. The first casing has an inner diameter greater than an outer diameter of the second casing forming the CCA. The cemented zone is located in the CCA. The wellhead is positioned uphole of the first casing and the second casing. The wellhead seals the CCA. The supply tank includes a heating component to heat the sealant material to a first temperature. The first temperature is equal to or greater than a melting point of the sealant material such that the sealant material is converted to its molten state. The first temperature is greater than a temperature of the wellbore. The pump is fluidly connected between the supply tank and the CCA. The pump is configured to pressurize the sealant material in its molten state. The pump is configured to inject the sealant material in its molten state into the CCA. The sealant material in its solid state occupies pores or imperfections of the cemented zone such that formation fluids are prevented from migrating to a surface of the wellbore.

In some embodiments, the wellhead includes a port. The port is configured to bleed the formation fluids to the surface of the wellbore or to inject a preheated nitrogen into the CCA. In some embodiments, the sealant material include paraffin wax. In some embodiments, the paraffin wax has a melting point ranging between 90 deg. C and 150 deg. C. In some embodiments, the paraffin wax in its molten state has a kinematic viscosity ranging between 1 $mm^2/s$ and 3.5 $mm^2/s$ at 120 deg. C.

BRIEF DESCRIPTION OF THE DRAWINGS

So that the manner in which the previously-recited features, aspects, and advantages of the embodiments of this disclosure as well as others that will become apparent are attained and can be understood in detail, a more particular description of the disclosure briefly summarized previously may be had by reference to the embodiments that are illustrated in the drawings that form a part of this specification. However, it is to be noted that the appended drawings illustrate only certain embodiments of the disclosure and are not to be considered limiting of the disclosure's scope as the disclosure may admit to other equally effective embodiments.

Figure 1:
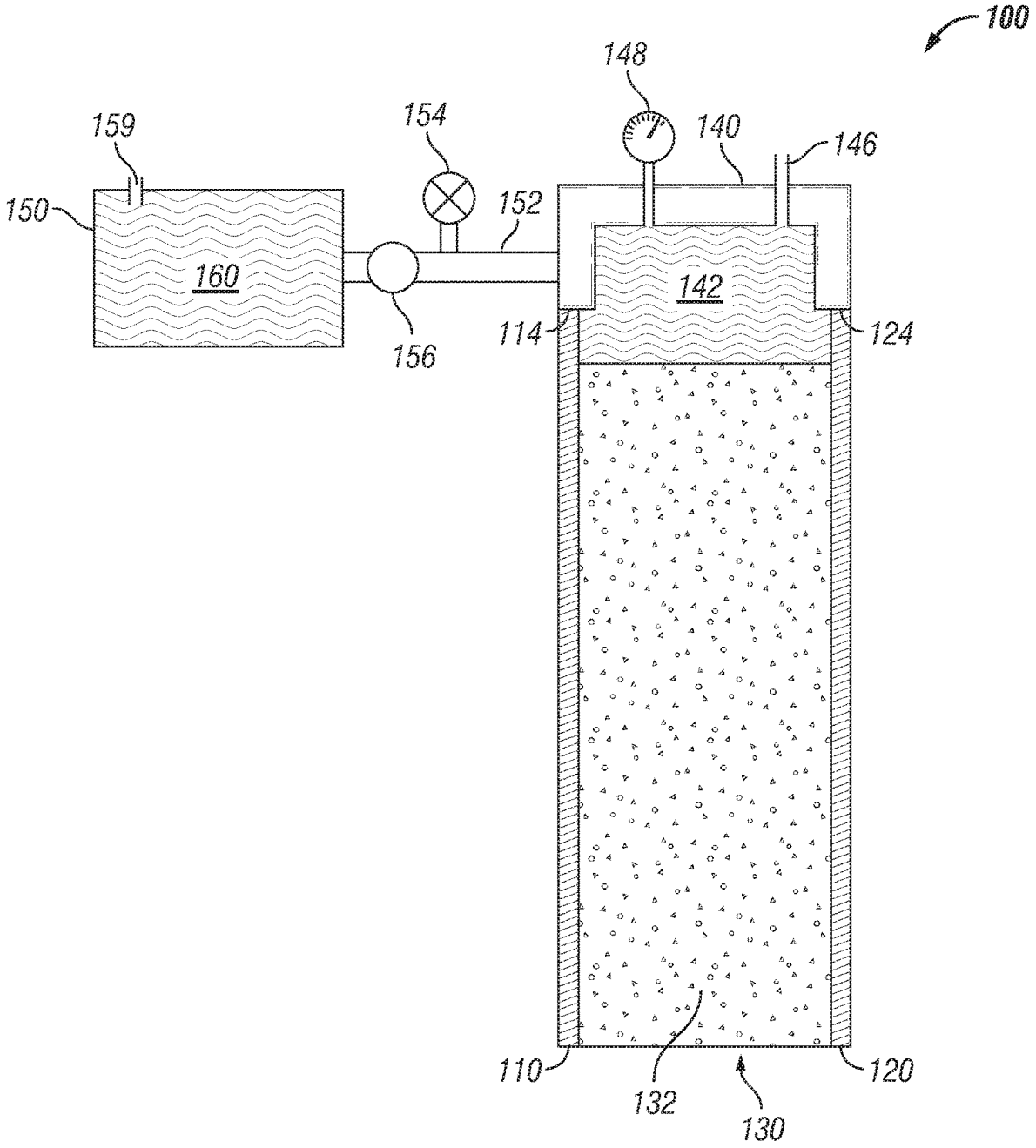
FIG. 1 is a schematic view of a CCA treating system according to an embodiment of the disclosure.

In the accompanying Figures, similar components or features, or both, may have a similar reference label.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended claims.

Those of skill in the art also understand that the terminology used for describing particular embodiments does not limit the scope or breadth of the embodiments of the disclosure. In interpreting the specification and appended claims, all terms should be interpreted in the broadest possible manner consistent with the context of each term. All technical and scientific terms used in the specification and appended claims have the same meaning as commonly understood by one of ordinary skill in the art to which this disclosure belongs unless defined otherwise.

Although the disclosure has been described with respect to certain features, it should be understood that the features and embodiments of the features can be combined with other features and embodiments of those features.

Although the disclosure has been described in detail, it should be understood that various changes, substitutions, and alternations can be made without departing from the principle and scope of the disclosure. Accordingly, the scope of the present disclosure should be determined by the following claims and their appropriate legal equivalents.

As used throughout the disclosure, the singular forms "a," "an," and "the" include plural references unless the context clearly indicates otherwise.

As used throughout the disclosure, the word "about" includes +/−5% of the cited magnitude.

As used throughout the disclosure, the words "comprise," "has," "includes," and all other grammatical variations are each intended to have an open, non-limiting meaning that does not exclude additional elements, components or steps. Embodiments of the present disclosure may suitably "comprise," "consist," or "consist essentially of" the limiting features disclosed, and may be practiced in the absence of a limiting feature not disclosed. For example, it can be recognized by those skilled in the art that certain steps can be combined into a single step.

As used throughout the disclosure, the words "optional" or "optionally" means that the subsequently described event or circumstances can or may not occur. The description includes instances where the event or circumstance occurs and instances where it does not occur.

Where a range of values is provided in the specification or in the appended claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended claims to a method comprising two or more defined steps, the defined steps can be carried out in any order or simultaneously except where the context excludes that possibility.

As used throughout the disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

As used throughout the disclosure, spatial terms described the relative position of an object or a group of objects relative to another object or group of objects. The spatial relationships apply along vertical and horizontal axes. Orientation and relational words, including "uphole," "downhole" and other like terms, are for descriptive convenience and are not limiting unless otherwise indicated.

As used throughout the disclosure, the term "wax" refers to a water-insoluble organic material that is solid or semi-solid at room temperature. Typically, wax has less density than that of water. Typically, wax can be melted above room temperature to transition to a liquid state. Wax can include naturally occurring and synthetic waxes, wax esters, and greases that have a melting temperature of 30 deg. C or greater, with a melting range of less than 10 deg. C. Wax can be non-reactive with reagents and solvents that may be present in the CCA.

Figure 2:
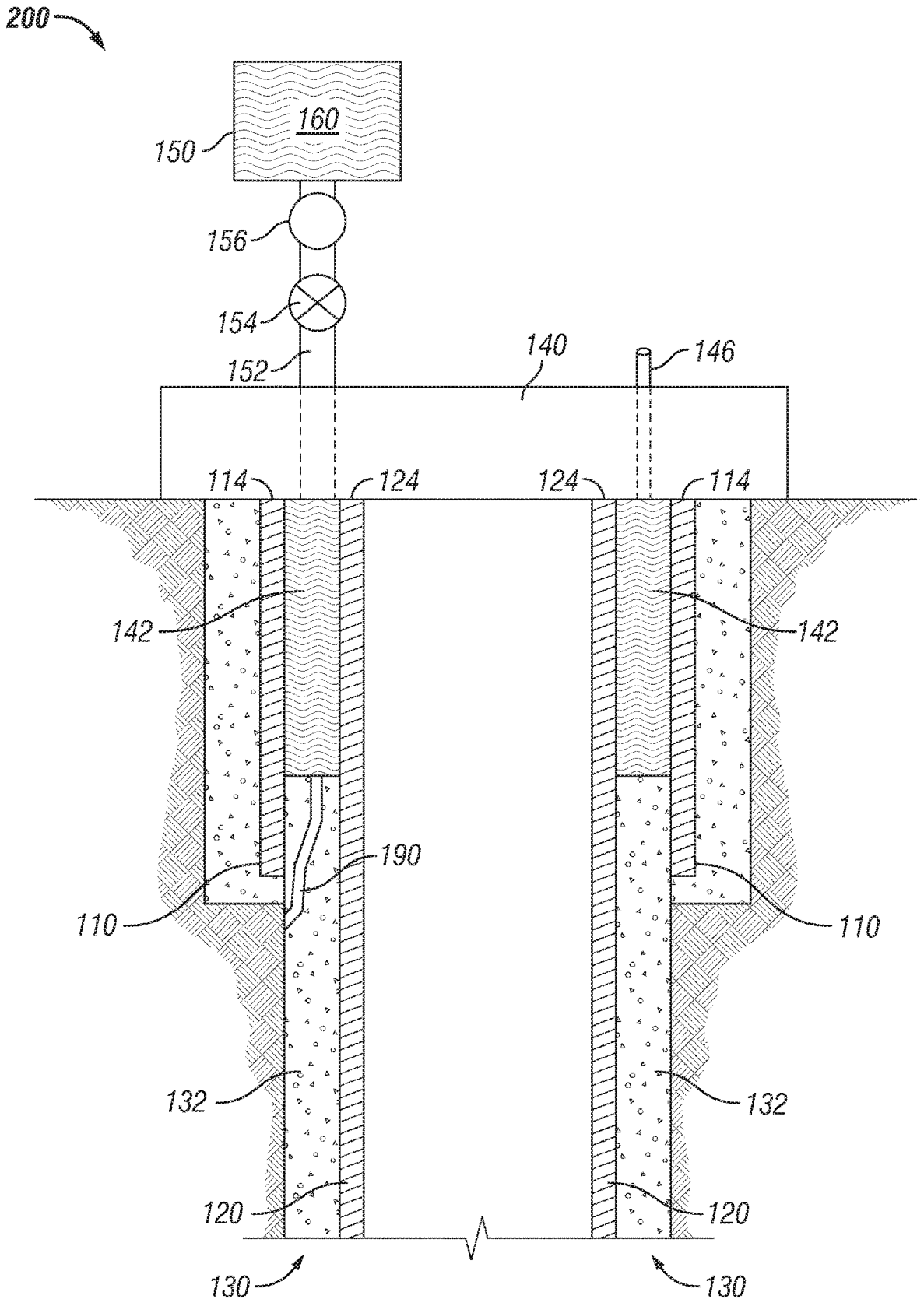
FIG. 2 is a schematic view of a CCA treating system according to an embodiment of the disclosure.

FIG. 1 shows a schematic view of a CCA treating system 100 according to an embodiment of the disclosure. FIG. 2 shows a schematic view of a CCA treating system 200 according to an embodiment of the disclosure. As shown in FIGS. 1 and 2, the CCA treating systems 100, 200 include a first casing 110 and a second casing 120. Non-limiting example materials used for the first casing 110 and the second casing 120 include carbon steel (with or without heat treatment), stainless steel, aluminum, titanium, or any like metal or alloy. The first casing 110 has an inner diameter greater than the outer diameter of the second casing 120. For example, the first casing 110 may have an inner diameter of about 24 inches and the second casing 120 may have an outer diameter of about 18⅝ inches. One skilled in the art would recognize that the casings 110, 120 can have any inner or outer diameters and wall thicknesses so long as the inner diameter of the first casing 110 is greater than the outer diameter of the second casing 120 to create the CCA 130. The CCA 130 is located between the annulus created by the inner diameter of the first casing 110 and outer diameter of the second casing 120. The CCA 130 includes a cemented zone 132 filled with hardened cement that may have pores or imperfections 190 that serve as pathways for formation fluids to migrate to the surface. Non-limiting example cements used for the hardened cement include all types of Portland cements, any type of cement as classified by the American Society for Testing and Materials (ASTM), such as Type I, II, III, or V, and any type of cement as classified by the American Petroleum Institute (API), such as Class A, C, G, or H. Portland cements are described in API specification for "Materials and Testing for Well Cements," API 10B-2 of the API. In some embodiments, the first casing 110 can include more than one casing joints assembled together via a threaded connection at each end. Likewise, the second casing 120 can include more than one casing joints assembled together via a threaded connection at each end.

A wellhead 140 is located uphole of the first casing 110 and the second casing 120 and is in contact with the upholemost edges 114, 124 of the first casing 110 and the second casing 120, respectively. The wellhead 140 seals the CCA 130 creating a non-cemented wellhead cavity 142 uphole of the cemented zone 132. The wellhead 140 can include a pressure gauge 148 to measure the pressure buildup caused by the formation fluids. The wellhead 140 can include one or more ports 146 to bleed pressurized formation fluids to the surface or to inject a gaseous material. Non-limiting example materials used for the wellhead 140 include carbon steel (with or without heat treatment), stainless steel, aluminum, titanium, or any like metal or alloy.

The non-cemented wellhead cavity 142 created by the wellhead 140 is in fluid contact with a supply tank 150 via pipe 152 along with a valve 154 and a pump 156. The supply tank 150 includes a sealant material 160. The supply tank 150 can include heating components (not shown) to maintain the sealant material 160 in the molten state or gaseous state. The supply tank 150 can include thermally insulating material (not shown) on the exterior. The molten or gaseous sealant material 160 can be pumped via the pump 156 through the pipe 152 to the wellhead cavity 142. Optionally, the sealant material 160 can be periodically replenished via the port 159 of the supply tank 150. In some embodiments, the sealant material 160 includes wax.

Non-limiting examples of wax include esters of fatty alcohols and fatty acids. In some embodiments, at least one carbon branch of the ester has 10 or more carbon atoms. In some embodiments, the ester includes various unsaturated and branched chain types. In some embodiments, the ester includes esters of glycerols and sterols. In addition, non-limiting examples of wax includes certain free alcohols or acids that have wax-like properties of melting temperature and inertness. Non-limiting examples of saturated fatty acids include capric, lauric, myristic, palmitic, margaric, stearic, arachidic, behenic, tetracosanic, lignoceric, cerotic, and melissic acid. Non-limiting examples of unsaturated fatty acids include tiglic, hypogaeic, gaidic, physetoleic, elaidic, oleic, isooleic, erudic, brassidic, and isoerudic acid. Non-limiting examples of fatty alcohols include octadecyl alcohol, carnaubyl alcohol, ceryl alcohol, melissyl alcohol, and phytol. In addition, non-limiting examples of wax includes various ester forms of such fatty alcohols, other fatty acids with suitable fatty alcoholic form, or sterols such as cholesterol, or glycerols.

Non-limiting examples of wax include natural or suitably modified waxes such as various plant derived waxes, greases and oils including carnauba wax, cranberry wax, ouricuri wax, candelilla wax, raphia wax, apple, cotton and cactus waxes. Non-limiting examples of wax include natural or suitably modified waxes such as waxes (including greases) produced by bacteria (for example, cetyl stearate), fungi, protozoa and algae. Non-limiting examples of wax include natural or suitably modified waxes such as various invertebrate waxes and greases including insect waxes such as beeswaxes (for example, triacontyl palmitate, palmatyl palmitate), and *Coccus* sp. derived waxes (for example, lac, cochineal and Chinese insect), and other animal fats (for example, triglycerides) and waxes including spermaceti (for example, cetyl palmitate), lanolin and wool grease. Non-limiting examples of wax also include various derivatives, extracts, and combinations of such materials.

Non-limiting examples of wax include many natural or synthetic hydrocarbons such as white waxes, paraffins, ceresins, silicon greases and waxes, polychlorinated or polyfluorinated hydrocarbons, aromatic hydrocarbons (such as naphthalene and durene(1,2,4,5-tetramethylbenzene)), polyether waxes and polyester waxes. Waxes include waxy polymers, which are polymers that have wax-like chemical or physical properties alone or when combined with other waxes. Non-limiting examples of waxy polymers include polyethylenes and polypropylenes. Non-limiting examples of polymers that may be combined with waxes to produce waxy polymers include certain gums and rubbers, various kinds of latex, gutta-percha, balata, chicle and various derivatives. Non-limiting examples of synthetic hydrocarbons include synthetic rubbers such as isoprene polymers, hydrogenated rubber, butadiene polymers, chloroprene polymers and butyl polymers.

Non-limiting examples of wax include gelatin, guar gum, acacia (gum arabic), carob bean gum, carrageenan, xanthan gum, food starch, carboxymethyl cellulose, ethyl cellulose, methyl cellulose, cellulose acetate, cellulose nitrate, silcone rubber, butyl rubber, butadiene-styrene rubber, polyurethane, epoxy, polyvinyl alcohol, polyvinyl acetate, polydimethyl siloxane, urea formaldehyde, polyethylene, polyethylene glycol, polystyrene, polymethyl methacrylate, polypropylene, polyvinyl chloride, polyvinyl alcohol, polycarbonate, and polyamide.

In at least one embodiment, the wax is paraffin wax. Paraffin wax can be naturally occurring or synthesized. Paraffin wax typically has a chemical formula of $C_nH_{2n+2}$, where integer n can be equal to or greater than 18. In some embodiments, integer n ranges between 18 and 52, alternately between 20 and 35, or alternately between 25 and 30. In alternate embodiments, integer n ranges between 18 and 52, alternately between 30 and 52, or alternately between 35 and 50.

The sealant material 160 can have a melting point greater than the reservoir or wellbore temperature. After injection into the pores or imperfections 190, the sealant material 160 is maintained in its solid or semi-solid state. Selecting and injecting a sealant material 160 having a melting point greater than the reservoir or wellbore temperature ensures that the sealant material 160 would not transition into a mobile form. In this manner, the sealant material 160 is prevented from being less viscous and being able to flow and migrate out of the pores or imperfections 190. In some embodiments, the sealant material 160 can have a melting point ranging between about 90 deg. C and about 250 deg. C, alternately between about 90 deg. C and about 200 deg. C, or alternately between about 90 deg. C and about 150 deg. C. In at least one embodiment, the sealant material 160 has a melting point of about 120 deg. C.

The molten or gaseous sealant material 160 can have a kinematic viscosity (defined as the ratio of the shear viscosity to the density of the fluid) ranging between about 1 $mm^2/s$ and about 7 $mm^2/s$ at about 120 deg. C, alternately between about 1 $mm^2/s$ and about 5 $mm^2/s$ at about 120 deg. C, or alternately between about 1 $mm^2/s$ and about 3.5 $mm^2/s$ at about 120 deg. C. In at least one embodiment, the sealant material 160 has a kinematic viscosity of about 3 $mm^2/s$ at about 120 deg. C. One skilled in the relevant art would recognize that the kinematic viscosity of the sealant material 160 generally decreases as the temperature increases. Because the molten or gaseous sealant material 160 has a lesser viscosity than conventional sealants such as cement slurries or resins, the molten or gaseous sealant material 160 can access deeper pore spaces in the cemented zone 132 of the CCA 130 than conventional sealants such as cement slurries and resin-based sealants. Resultantly, the molten or gaseous sealant material 160 can access such pore spaces to plug certain zones in the CCA 130 whereas conventional sealants cannot. One skilled in the relevant art would also recognize that a relatively lesser pumping pressure is required for a sealant material 160 having a relatively lesser viscosity.

The molten or gaseous sealant material 160 is pressurized and pumped into the non-cemented wellhead cavity 142 via the pump 156. The sealant material 160 not only fills the wellhead cavity 142 but also penetrates into the pores or imperfections 190 of the cemented zone 132 due to its reduced kinematic viscosity at elevated temperatures of greater than about 120 deg. C. Optionally, before injection of the molten or gaseous sealant material 160, the CCA 130 including the wellhead cavity 142 and the cemented zone 132 can be preheated to a temperature greater than the reservoir or wellbore temperature. Optionally, before injection of the molten or gaseous sealant material 160, the CCA 130 including the wellhead cavity 142 and the cemented zone 132 can be preheated to a temperature greater than the melting point of the sealant material 160. Heating of the CCA 130 can be achieved by injecting preheated gaseous materials such as air or nitrogen into the wellhead cavity 142 via port 146. Heating of the CCA 130 can be achieved by positioning a heating component in the CCA via a wireline or drill pipe. Heating of the CCA 130 can be achieved by circulating a preheated fluid such as mud using a drill pipe or coiled tubing. Heating of the CCA 130 can be achieved by transferring heat of a continuously producing hydrocarbon fluid. Injection of the pressurized and molten or gaseous sealant material 160 into the cemented zone 132 can be continued until the pores or imperfections 190 of the cemented zone 132 are occupied with the sealant material 160. One skilled in the relevant art would recognize that the pumping pressure of the molten or gaseous sealant material 160 depends on the permeability of the cemented zone 132. For example, a relatively lesser pumping pressure is required for a cemented zone 132 having a relatively greater permeability. Other factors that may contribute to the pumping pressure of the molten or gaseous sealant material 160 include viscosity and flow rate of the sealant material 160, and length and cross sectional area of the cemented zone 132.

Once the pores or imperfections 190 of the cemented zone 132 are occupied with the sealant material 160, the sealant material 160 is allowed to cool down to a temperature less than the melting point such that the molten or gaseous sealant material 160 solidifies. In this manner, formation fluids are prevented from migrating to the surface due to the solidified sealant material 160 plugging possible pathways for pressure buildup.

In an example embodiment of the method, a wellbore is drilled and the first casing 110 and the second casing 120 are deployed in the wellbore. The first casing 110 has an inner diameter greater than an outer diameter of the second casing 120 forming the CCA 130. After deployment, a cement slurry is introduced in the CCA 130 and is allowed to harden. The wellhead 140 is placed uphole of the first casing 110 and the second casing 120 making contact with the first casing 110 and the second casing 120 and sealing the CCA 130. Through port 146, any pressurized formation fluids can be bled to the surface. Preheated nitrogen can be injected into the CCA 130 through port 146 such that formation fluids are displaced and the wellhead cavity 142 and pores or imperfections 190 of the cemented zone 132 are preheated to a temperature greater than the melting point of the sealant material 160. The sealant material 160 in the supply tank 150 is heated to a temperature greater than the melting point of the sealant material 160 such that the sealant material 160 is in its molten or gaseous state. The valve 154 is opened such that the molten or gaseous sealant material 160 is pressurized via pump 156 and injected into the CCA 130 through pipe 152. Injection of the molten or gaseous sealant material 160 can be continued until the pores or imperfections 190 of the cemented one 132 are saturated with the molten or gaseous sealant material 160. After saturation, the valve 154 is closed and the molten or gaseous sealant material 160 is cooled down to a temperature less than the melting point to solidify the sealant material 160.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments described in the disclosure. It is to be understood that the forms shown and described in the disclosure are to be taken as examples of embodiments. Elements and materials may be substituted for those illustrated and described in the disclosure, parts and processes may be reversed or omitted, and certain features may be utilized independently, all as would be apparent to one skilled in the art after having the benefit of this description. Changes may be made in the elements described in the disclosure without departing from the spirit and scope of the disclosure as described in the following claims. Headings used described in the disclosure are for organizational purposes only and are not meant to be used to limit the scope of the description.

What is claimed is:

1. A method for treating a casing-casing annulus (CCA) of a wellbore using a sealant material, the method comprising the steps of:

heating the sealant material to a first temperature, wherein the first temperature is equal to or greater than a melting point of the sealant material such that the sealant material is in its molten state;

heating the CCA to a second temperature, wherein the second temperature is equal to or greater than the melting point of the sealant material;

pressurizing the sealant material in its molten state;

positioning a wellhead uphole of a first casing and a second casing sealing the CCA;

bleeding formation fluids to a surface of the wellbore via a port of the wellhead;

injecting the sealant material in its molten state into the CCA such that the sealant material in its molten state occupies pores or imperfections of a cemented zone located in the CCA; and allowing the sealant material to solidify such that the formation fluids are prevented from migrating to the surface of the wellbore, wherein the CCA is formed by the first casing and the second casing, wherein the first casing has an inner diameter greater than an outer diameter of the second casing, wherein the sealant material is a wax selected from the group consisting of: esters of fatty alcohols and fatty acids, natural or suitably modified waxes, natural or synthetic hydrocarbons, waxy polymers, and combinations thereof.

2. The method of claim 1, further comprising the step of: deploying the first casing and the second casing in the wellbore.

3. The method of claim 1, further comprising the steps of: introducing a cement slurry in the CCA; and allowing the cement slurry to harden to form the cemented zone.

4. The method of claim 1, wherein the heating the CCA step, a preheated gaseous material is injected into the CCA via the port of the wellhead.

5. The method of claim 4, wherein the preheated gaseous material comprises nitrogen.

6. The method of claim 1, wherein the sealant material comprises paraffin wax.

7. The method of claim 1, wherein the melting point of the sealant material ranges between 90 deg. C and 150 deg. C.

8. The method of claim 7, wherein the melting point of the sealant material is 120 deg. C.

9. The method of claim 1, wherein the sealant material in its molten state has a kinematic viscosity ranging between 1 $mm^2/s$ and 3.5 $mm^2/s$ at 120 deg. C.

10. The method of claim 9, wherein the sealant material in its molten state has a kinematic viscosity of 3 $mm^2/s$ at 120 deg. C.

11. The method of claim 1, wherein the first temperature is greater than a temperature of the wellbore.

12. The method of claim 1, wherein the heating the sealant material step further includes the sealant material positioned in a supply tank, wherein the supply tank is fluidly connected to the CCA.

13. The method of claim 12, wherein the supply tank includes a heating component.

14. A system for treating a casing-casing annulus (CCA) of a wellbore, the system comprising:

a sealant material;

a first casing;

a second casing, the first casing having an inner diameter greater than an outer diameter of the second casing forming the CCA;

a cemented zone, the cemented zone located in the CCA;

a wellhead, the wellhead positioned uphole of the first casing and the second casing, the wellhead sealing the CCA;

a supply tank, the supply tank including a heating component to heat the sealant material to a first temperature, wherein the first temperature is equal to or greater than a melting point of the sealant material such that the sealant material is converted to its molten state, wherein the first temperature is greater than a temperature of the wellbore; and a pump, the pump fluidly connected between the supply tank and the CCA, the pump configured to pressurize the sealant material in its molten state, the pump configured to inject the sealant material in its molten state into the CCA, wherein the sealant material in its solid state occupies pores or imperfections of the cemented zone such that formation fluids are prevented from migrating to a surface of the wellbore, wherein the sealant material is a wax selected from the group consisting of: esters of fatty alcohols and fatty acids, natural or suitably modified waxes, natural or synthetic hydrocarbons, waxy polymers, and combinations thereof, wherein the system is used to bleed the formation fluids to the surface of the wellbore via a port of the wellhead.

15. The system of claim 14, wherein the system is used to inject a preheated nitrogen into the CCA via the port of the wellhead.

16. The system of claim 14, wherein the sealant material comprises paraffin wax.

17. The system of claim 16, wherein the paraffin wax has a melting point ranging between 90 deg. C and 150 deg. C.

18. The system of claim 16, wherein the paraffin wax in its molten state has a kinematic viscosity ranging between 1 $mm^2/s$ and 3.5 $mm^2/s$ at 120 deg. C.

* * * * *